US012377308B2

(12) United States Patent
Solecki

(10) Patent No.: US 12,377,308 B2
(45) Date of Patent: Aug. 5, 2025

(54) CALF EXERCISE DEVICE

(71) Applicant: Owen Douglas Solecki, Calgary (CA)

(72) Inventor: Owen Douglas Solecki, Calgary (CA)

( * ) Notice: Subject to any disclaimer, the term of this patent is extended or adjusted under 35 U.S.C. 154(b) by 187 days.

(21) Appl. No.: 17/462,056

(22) Filed: Aug. 31, 2021

(65) Prior Publication Data

US 2023/0069150 A1 Mar. 2, 2023

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/035*** | (2006.01) |
| ***A63B 23/08*** | (2006.01) |

(52) U.S. Cl.

CPC .... *A63B 21/4034* (2015.10); *A63B 21/00185* (2013.01); *A63B 21/0442* (2013.01); *A63B 21/0557* (2013.01); *A63B 23/03508* (2013.01); *A63B 23/08* (2013.01)

(58) Field of Classification Search

CPC ..... A63B 21/4034; A63B 21/00185; A63B 21/0442; A63B 21/0557; A63B 23/03508; A63B 23/08; A63B 23/085; A63B 22/16; A63B 26/00–03; A63B 2026/006; A61H 1/0266; A61H 1/02; A61H 1/0237

See application file for complete search history.

(56) References Cited

U.S. PATENT DOCUMENTS

| | | | | |
|---|---|---|---|---|
| 2,467,943 A * | 4/1949 | Mikell, Jr. | A63B 23/085 | 482/79 |
| 4,728,103 A * | 3/1988 | Fulton | A63B 23/085 | 482/125 |
| 4,930,767 A * | 6/1990 | Hamm | A63B 21/4025 | 482/80 |
| 5,433,684 A | 7/1995 | Carrillo | | |
| 5,643,164 A * | 7/1997 | Teff | A63B 23/08 | 482/79 |
| 6,421,935 B1 * | 7/2002 | Bartlett | A43B 13/143 | 482/79 |
| 6,589,141 B1 | 7/2003 | Flaggs | | |
| 6,709,369 B1 * | 3/2004 | Jacobs | A63B 22/16 | 482/79 |
| 7,266,912 B2 | 9/2007 | Whatley | | |
| 7,896,784 B2 * | 3/2011 | Campbell | A63B 21/0023 | 482/907 |
| 8,360,940 B2 | 1/2013 | Kole et al. | | |
| 9,017,235 B2 | 4/2015 | Khademi | | |
| 10,206,845 B1 | 2/2019 | Barouche | | |
| 10,549,142 B1 * | 2/2020 | Ash | A61H 1/0266 | |

(Continued)

FOREIGN PATENT DOCUMENTS

| | | | |
|---|---|---|---|
| CA | 2976560 A1 * | 2/2019 | |
| DE | 202012101446 U1 * | 6/2012 | A61H 7/001 |

OTHER PUBLICATIONS

Search Report From Corresponding UK Application No. 2211594.3.

*Primary Examiner* — Loan B Jimenez
*Assistant Examiner* — Kathleen M Fisk
(74) *Attorney, Agent, or Firm* — Orin Del Vecchio

(57) ABSTRACT

The device as disclosed herein is simple and easy to use, and inexpensive to produce. It provides a good calf workout from home for the calf and lower leg. It includes a foot baseplate having a lower curved surface or frame, a series of straps to attach the users foot to the baseplate and an attachment point for a resistance band.

15 Claims, 17 Drawing Sheets

(56) References Cited

U.S. PATENT DOCUMENTS

| | | | | |
|---|---|---|---|---|
| D886,918 | S | 6/2020 | Flaggs | |
| 2010/0035734 | A1 | 2/2010 | Digiovanni | |
| 2012/0115692 | A1* | 5/2012 | Bussen | A63B 23/0355 482/130 |
| 2013/0231227 | A1* | 9/2013 | Ranieri | A63B 21/00061 482/124 |
| 2016/0339296 | A1* | 11/2016 | Barel | A63B 23/08 |
| 2019/0201731 | A1* | 7/2019 | Nguyen | A63B 21/4015 |
| 2022/0273982 | A1* | 9/2022 | Malagon | A63B 23/03525 |

* cited by examiner

CALF EXERCISE DEVICE

FIELD OF THE INVENTION

The present invention relates generally to the field of devices that assist in exercising the lower leg muscles, specifically to devices having foot baseplates, more specifically to devices having foot baseplates optionally attached to resistance bands.

BACKGROUND

A pulled calf muscle happens when muscles are overstretched in the back of the lower leg. This is a common injury with athletes performing repetitive stop-and-go movements, but it can also affect other active individuals. Most calf strains heal with rest, ice, compression and elevation. In rare cases, calf muscle tears require surgery.

A pulled calf muscle, or a calf muscle strain, occurs when the muscles in the calf—the soleus and gastrocnemius—are overstretched. Calf muscles are in the lower leg behind the shin bone and extend from the base of the thigh down to the heel. They assist with flexing and bending the foot, ankle and knee. A calf strain can cause pain and prevent individuals from running, jumping and doing other activities. A severely pulled calf muscle can result in partial or complete tears, which may require surgery.

Studies have estimated that calf strains make up about 1.3% of all lower limb injuries in runners. Other studies of soccer players identified gastrocnemius strains as making up 12% of all muscle injuries. Gastrocnemius strains (near the middle of the calf) are more common than soleus strains (the lower calf, closer to the heel).

The causes of calf muscle strains include people not warming up or stretching before physical activity, or conditioning the muscles before the start of a sports season. Some people have tight or short calf muscles and therefor have a higher risk of calf strains.

Symptoms include: difficulty tensing calf muscles or standing on toes; muscle pain when flexing the ankle or pointing toes; difficulty bending the knee; a snapping or popping sensation in the calf; sudden pain in the back of the lower leg; swelling or bruising in the calf muscle.

It is possible to reduce the risk of a pulled calf muscle by: keeping the calf muscles strong and conditioned; stretching routinely; not pushing through pain; resting and recovering between workouts; using proper technique when playing sports; warming up and stretching the calf muscles before physical activity; and wearing supportive footwear that fits properly.

Various different devices are known that assist with exercising calf muscles in order to strengthen the calf muscles to prevent injury, or to rehabilitate calf muscles after injury.

U.S. Pat. Appl. 2013/0231227 (Ranieri) discloses a resistance exercise device. The resistance exercise device comprising a first elastic resistance member, a knee attachment having a first attachment mechanism for attachment to said first elastic member and a second attachment mechanism for attachment to a user's distal thigh, a foot attachment having a first attachment mechanism for attachment to said first elastic member, a second attachment mechanism for attachment to a user's distal foot, in which one of the attachment mechanisms for attachment to the first elastic member provides a variable length attachment; and in which the exercise device is configured and arranged to provide an upwards force on the user's foot when worn by a user. A disadvantage of this type of device is that lateral movement is not prevented, which can exacerbate pulled muscles.

U.S. Pat. No. 7,266,912 (Whatley) discloses an exercise sole. The exercise device includes a sole with an upper surface on which a wearer's foot rests and a lower partially ground contacting surface. The sole has a heel, a midfoot, a forefoot and a toe region such that when the heel region lower surface and the forefoot region lower surface are in ground contact, the upper surface does not incline upwards from the forefoot to the heel region. The forefoot lower surface of the sole is generally radiused in a cylindrical curve about the line connecting the mid points of the first and second metatarsal-phalangeal joints of the wearer. When the wearer contracts their calf muscles, the heel section is lifted away from the ground, requiring work against gravity. A drawback of this device is that no resistance is provided in relation to the movement of the foot.

U.S. Pat. Appl. 2019/0201731 (Nguyen) discloses an adjustable leg exercise apparatus. The device is an adjustable leg exercise apparatus for allowing a user to perform a leg exercise while sitting on a sitting structure, or alternatively, when standing in a modified standing position. In a first embodiment, the adjustable leg exercise apparatus includes a foot engagement member; a knee-thigh engagement member; at least one elastic resistance member; at least one foot securing mechanism for securing or locking the foot engagement member to the at least one elastic resistance member; at least one knee-thigh securing mechanism for securing or locking the knee-thigh engagement member to the at least one elastic resistance member; and a plurality of length adjustment and securing devices for securing each of the at least one elastic resistance member in any one of a plurality of predetermined adjustment positions. In a second embodiment, the knee-thigh engagement member may include a knee-thigh wrapping device. The disadvantage of this device is that the lateral movement is not prevented, which can re-injure pulled muscles.

U. S. Des 886,918 (Flaggs) discloses a design for a calf exercise device. The device has a foot plate rotationally attached to a base plate at the toe region and hingedly attached to the base plate at the heel region. The device prevents lateral movements of the foot in relation to the knee, but does not provide any form of increased resistance.

U.S. Pat. No. 9,017,235 (Khademi) discloses a stretching and exercise device and method. The stretching and exercise device has a first strap member having a pair of end portions, a second strap member having a pair of end portions, and a pair of resistance members connected between respective end portions of the first and second strap members. A third strap member has a pair of end portions attached to respective first and second surface portions of the second strap member. A fourth strap member is attached to a third surface portion of the second strap member different from the first and second surface portions thereof. This device involves straps that are looped around the arm of the user, and requires the user to lay on the floor, which reduces the ease of use for the elderly, and also increases the risk of straining muscles in other parts of the body, such as the arms.

U.S. Pat. No. 10,206,845 (Barouche) discloses a calf stretching apparatus. The apparatus having a base having a lower surface defining a lower surface plane, a front end, a rear end opposing the rear end of the base, the rear end of the base having a rear edge defining a recessed base through opening and a foot placement platform with a front end, a rear end opposing the front end of the foot placement platform, a platform surface spanning in an upward direction with respect the base from the front end of the foot placement platform to the rear end of the foot placement platform and disposed at an acute angle with respect to the lower surface plane, a platform sidewall surrounding the platform surface on three sides thereof, wherein the rear end of the foot placement platform has a rear edge defining a recessed platform through opening aligned with the recessed base through opening. This device has a base plate, to prevent lateral motion, but any means of applying an external pressure must be provided by some other device, such as use in conjunction with a door jamb or frame.

U.S. Pat. No. 5,433,684 (Carrillo) discloses a calf workout device comprising a base formed in a generally planar rectangular configuration with a toe side edge, a heel side edge, and parallel long side edges. The base includes two planar side faces which extend vertically upward from the long side edges. Each side face includes a coupling device at its approximate center point. A foot plate is shaped in a generally rectangular configuration with a toe edge, a heel edge, and parallel long side edges. The toe edge is linear and the heel edge is formed in a semi-circular configuration. The heel edge includes an upwardly extending cylindrical wall. The approximate center point of the long edges of the plate include an aperture which extends from side to side. A cylindrical axle is positioned through the foot plate with its ends coupled to the side faces. The foot plate includes a resilient device for urging the plate in one direction. This device has a base plate and a means of applying a resistive force, the device however, is configured such that the resting position of the device is in the extended position for the calf muscles.

U.S. Pat. No. 4,728,103 (Fulton) discloses a leg and ankle exercising device. An exercising device for strengthening joints of the body, particularly the ankle joint, wherein a plate engageable against the foot of the user imparts controlled resistance in all directional movements of the joint through elastic limbs having one set of corresponding ends attached to predetermined points around the periphery of the plate and the other set of corresponding ends attached to a pair of handles which are gripped by the user for varying the degree of resistance imparted by the limbs. The device is a complex piece of equipment with many parts, and requires the user to manipulate the device in a precise and controlled manner using both arms.

U.S. Pat. No. 10,549,142 (Ash) discloses a calf-stretching device. The calf-stretching device is a mechanical apparatus, configured for use by a patient. The calf-stretching device is configured for use in exercise. The patient uses the calf-stretching device to stretch the calf as a part of an exercise program. The calf-stretching device comprises a foot bed and a supporting structure. The supporting structure holds the foot bed at a stretch angle. The supporting structure is a rotating structure. The foot of the patient rests on the foot bed during use of the calf-stretching device. The foot rotates the supporting structure to vary the stretch angle of the foot bed during use of the calf-stretching device. The orientation of the foot bed within the supporting structure is adjustable such that the range of the stretch angle available to the patient over the exercise period can be adjusted. This is another example of a simple mechanical device lacking a resistance applying member.

U.S. Pat. No. 8,360,940 (Kole) discloses a lower leg and foot exercise device. An exercise device for a lower leg and foot is provided. The exercise device provides a user with the ability to exercise multiple muscles in both lower legs and both feet, and provides the user with multiple exercises with a single exercise device. Additionally, the exercise device is capable of providing variable resistances during exercise to accommodate users of different strength and to accommodate a user's increase in strength. To provide variable resistance, the exercise device includes a plurality of resilient resistance member interchangeably coupled to a housing of the exercise device. This device is more specifically designed to exercise the intrinsic and extrinsic muscles of the foot including the toes, metatarsal arch calf and shins. The device comprises many parts, and requires the user to manipulate the foot, toes and ankle in a precise and controlled manner.

U.S. Pat. No. 6,589,141 (Flaggs) discloses an apparatus and method for stretching calf muscles. The footwear is employed for stretching an individual's calf muscles. The footwear includes a base member and a foot support member angularly disposed relative to the base member. The angle between the base member and the foot support member can be adjusted. The apparatus and method encompasses footwear to be worn by an individual for stretching the individual's calf muscles. The footwear includes a base member having a base member bottom for engaging the ground or other surface, a base member front end and a base member back end. This is another example of a mechanical device lacking resistance applying members, or the ability to adjust the resistive forces being applied.

All documents cited herein are incorporated by reference.

None of the above cited documents, alone or in combination satisfy the need for a simple and easy to use calf workout device that provides an effective calf and lower leg workout device from home that addresses the above-mentioned deficiencies.

BRIEF SUMMARY

It is an object of the invention to provide a calf exercise device.

In accordance with an aspect of the invention there is provided a calf exercise device, comprising: a planar baseplate having an approximate size and shape of a user's foot, said baseplate having a toe region and a heel region and two essentially parallel side edges extending therebetween; a pair of similarly sized and shaped contoured side pieces, each of said contoured side pieces having an upper edge and a lower edge, each of said upper edges attached to one of said parallel side edges, and each of said lower edges having a convex shaped contour; one or more straps affixed to either said parallel side edges of said baseplate or said upper edges of said contoured side pieces, said straps positioned to extend over one or more of toes, arch or heel of said user's foot; a connection point or points for attachment of a resistance band or strap to said toe region of said baseplate.

In accordance with another aspect of the invention there is provided a method of exercising a user's calf muscles, using the device as described above, said method comprising: said user sitting on an object having a distance from a floor that results in said user's lower and upper leg being at approximate right angle at user's knee joint; inserting one or more of said user's toes, arch and heel between said one or more straps and said baseplate, forming a resting position; attaching said resistance band to said notch; attaching said resistance band to a horizontal section of said user's upper leg; said user pushing said toes down onto said baseplate, against said resistance band to a flexing position; said user relaxing and allowing said resistance band to pull baseplate back to said resting position; and said user repeating said flexing and relaxing positions.

In accordance with another aspect of the invention there is provided a method of exercising a user's calf muscles, using the device as described above, said method comprising: said user standing a flat surface; inserting one or more of said user's arch, toes, and heel between said one or more straps and said baseplate, forming a resting position; attaching said resistance band to said notch; holding said resistance band with user's hand; said user pushing said toes down onto said baseplate, against said resistance band to a flexing position; said user relaxing and allowing said resistance band to pull baseplate back to said resting position; and said user repeating said flexing and relaxing positions.

The advantages and features of the present invention will become better understood with reference to the following more detailed description and claims taken in conjunction with the accompanying drawings in which like elements are identified with like symbols.

To easily identify the discussion of any particular element or act, the most significant digit or digits in a reference number refer to the figure number in which that element is first introduced.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Devices and methods for carrying out the invention are presented in terms of embodiments depicted within the FIGS. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and the configurations shall be shown and described for purposes of clarity and disclosure and not by way of limitation of scope.

The device as disclosed herein is simple and easy to use, and inexpensive to produce. It provides a good calf workout from home for the calf and lower leg. It comprises a foot baseplate having a lower curved surface or frame, a series of straps to attach the user's foot to the baseplate and an attachment point for a resistance band.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

Figure 1:
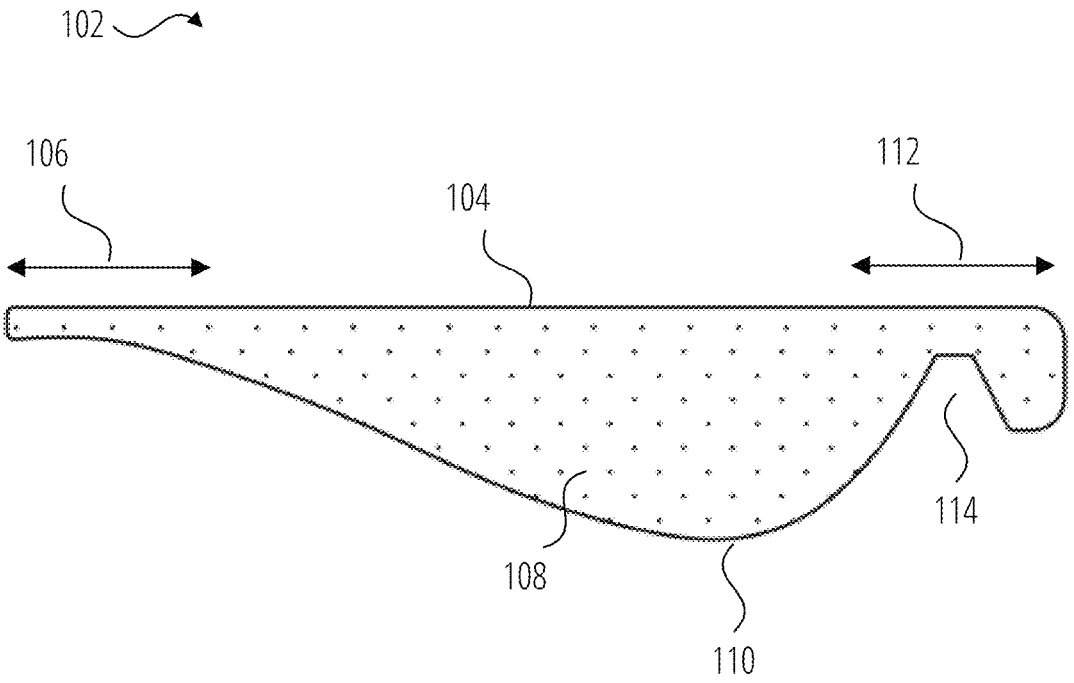
FIG. 1 illustrates a side view of the subject matter in accordance with one embodiment of the invention.

FIG. 1 shows a side view of the foot baseplate 102 in accordance with one embodiment.

The foot baseplate 102 having an upper surface 104, a contoured side 108, a heel region 106 and a toe region 112. A notch 114 can be seen formed in the contoured side 108 in the toe region 112.

Figure 2:
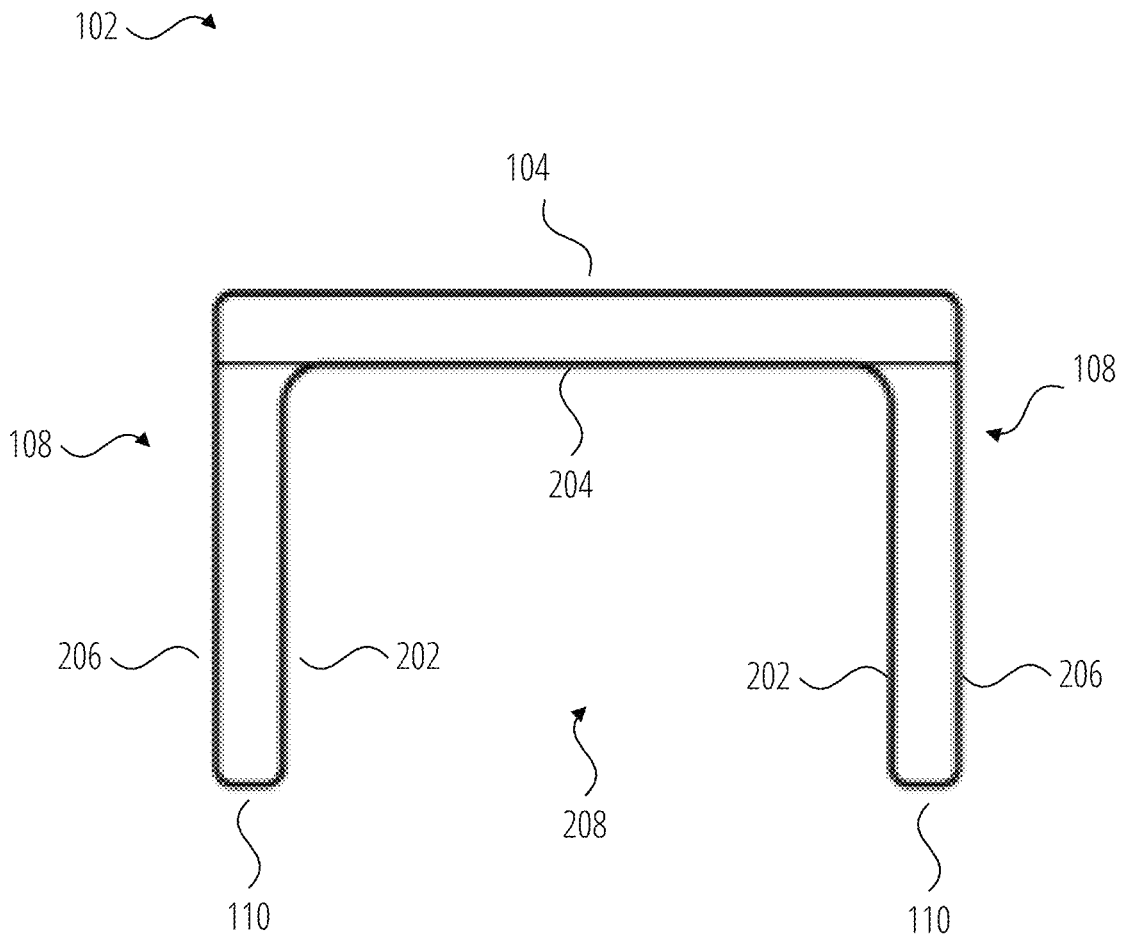
FIG. 2 illustrates an end view of the subject matter in accordance with one embodiment of the invention.

FIG. 2 shows an end view of the foot baseplate 102 in accordance with one embodiment.

The upper surface 104 can be seen to be attached to the contoured sides 108 at approximately right angles to the flat upper surface 104. The contoured sides 108 having an inner side 202 and an outer side 206. In the embodiment of the invention illustrated in FIG. 2, lower surface 204 of the foot baseplate 102 and the inner sides 202 of the contoured sides 108 form an inner space 208. The floor contact surface 110 of the foot baseplate 102 can be seen to be positioned at the lower edges of the contoured sides 108.

Figure 3:
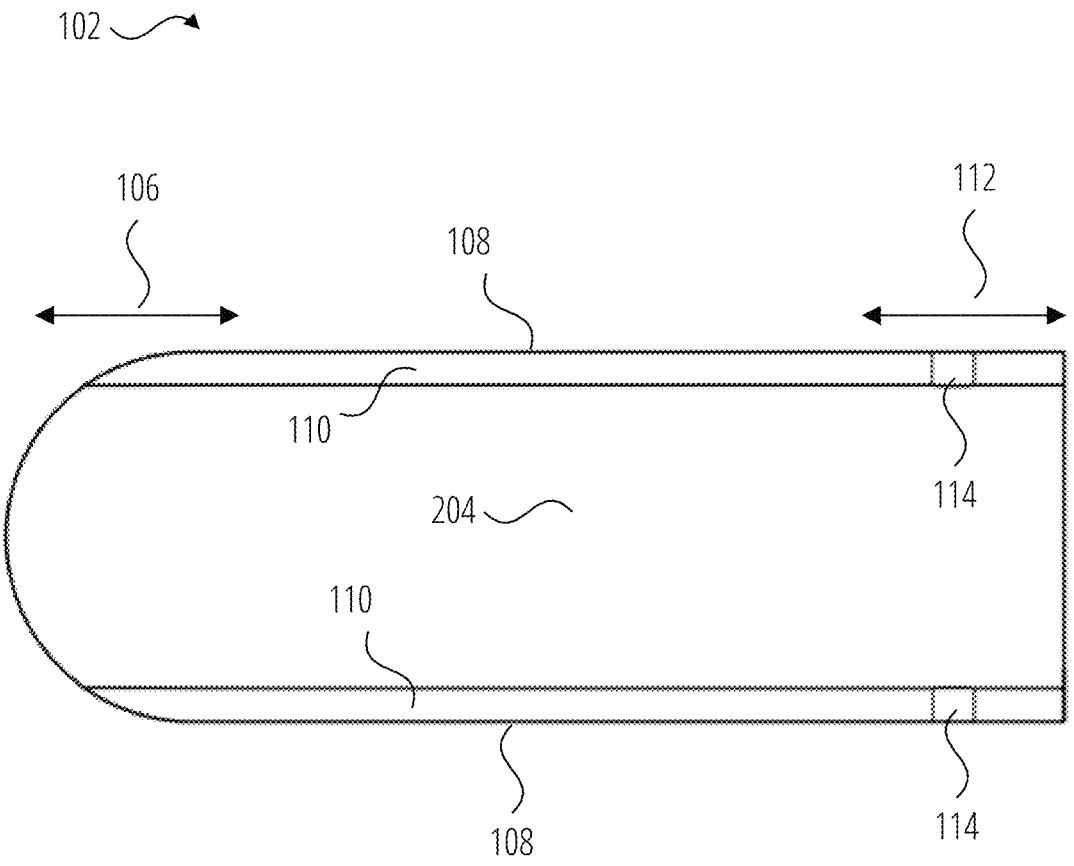
FIG. 3 illustrates an underside view of the subject matter in accordance with one embodiment of the invention.

FIG. 3 shows an underside view of the foot baseplate 102 in accordance with one embodiment.

In one embodiment of the invention, the heel region 106 of the foot baseplate 102 is curved and the toe region 112 is essentially flat and at right angles to the contoured sides 108. The notch 114 can be seen formed in each of the contoured sides 108 in the toe region 112 of the foot baseplate 102.

Figure 4:
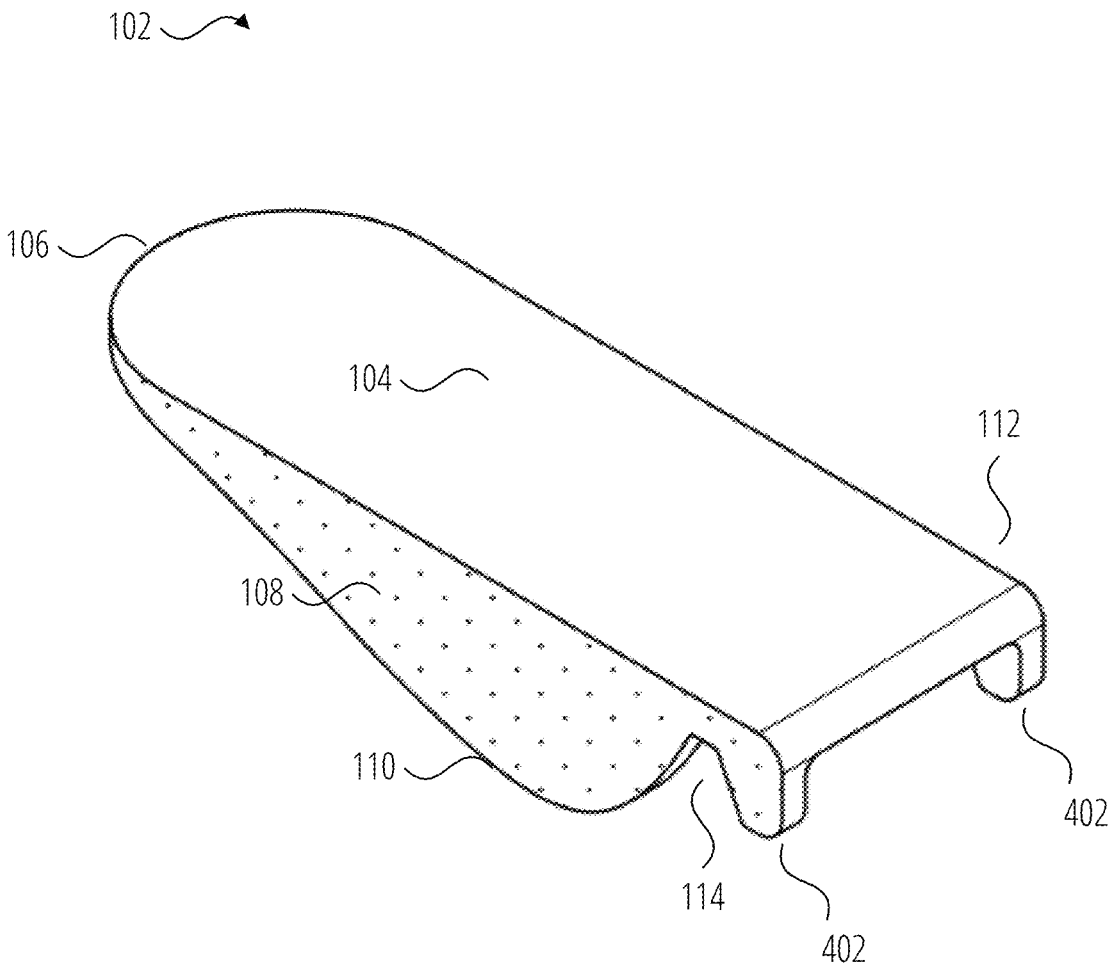
FIG. 4 illustrates a perspective view of the subject matter in accordance with one embodiment of the invention.

FIG. 4 shows a perspective view of the foot baseplate 102 in accordance with one embodiment.

The shape of the foot baseplate 102 resembles that illustrated in FIG. 3 in that it has a curved heel region 106 and a flat toe region 112. The contoured sides 108 have a notch 114, as illustrated in FIG. 1. The notch 114 is formed between the floor contact surface 110 and a stop 402.

Figure 5:
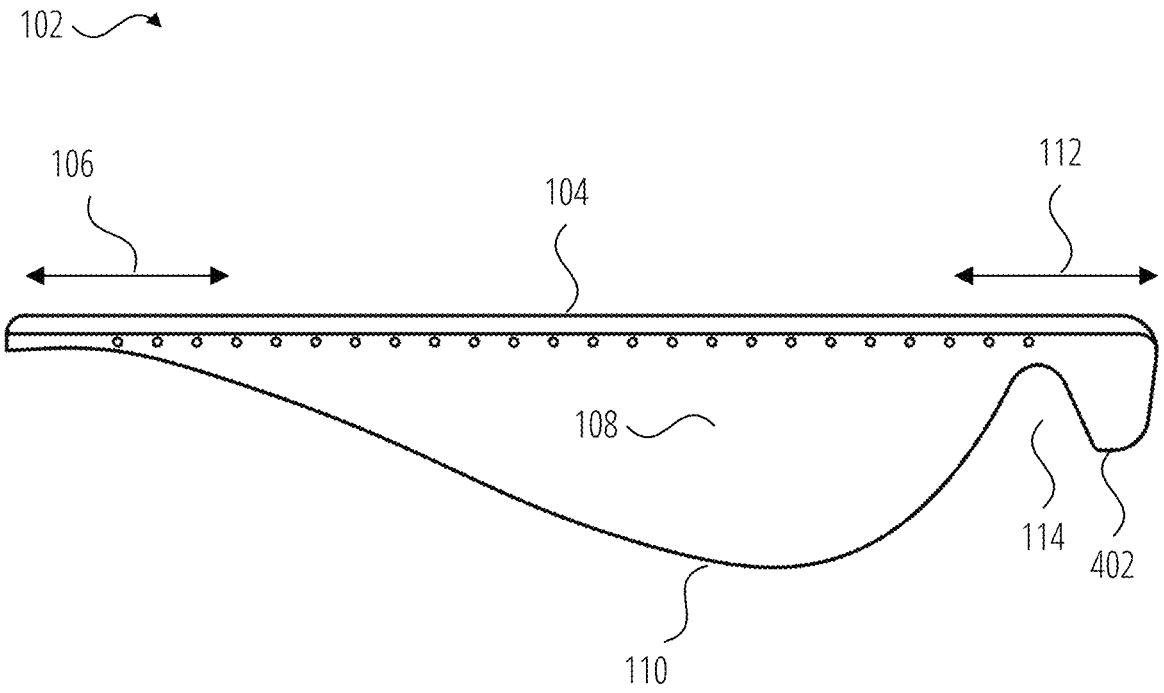
FIG. 5 illustrates a side view of the subject matter in accordance with an additional embodiment of the invention.

FIG. 5 shows a side view of the foot baseplate 102 in accordance with an additional embodiment of the invention.

The foot baseplate 102 having an upper surface 104, a contoured side 108, a heel region 106 and a toe region 112. A notch 114 can be seen formed in the contoured side 108 in the toe region 112.

Figure 6:
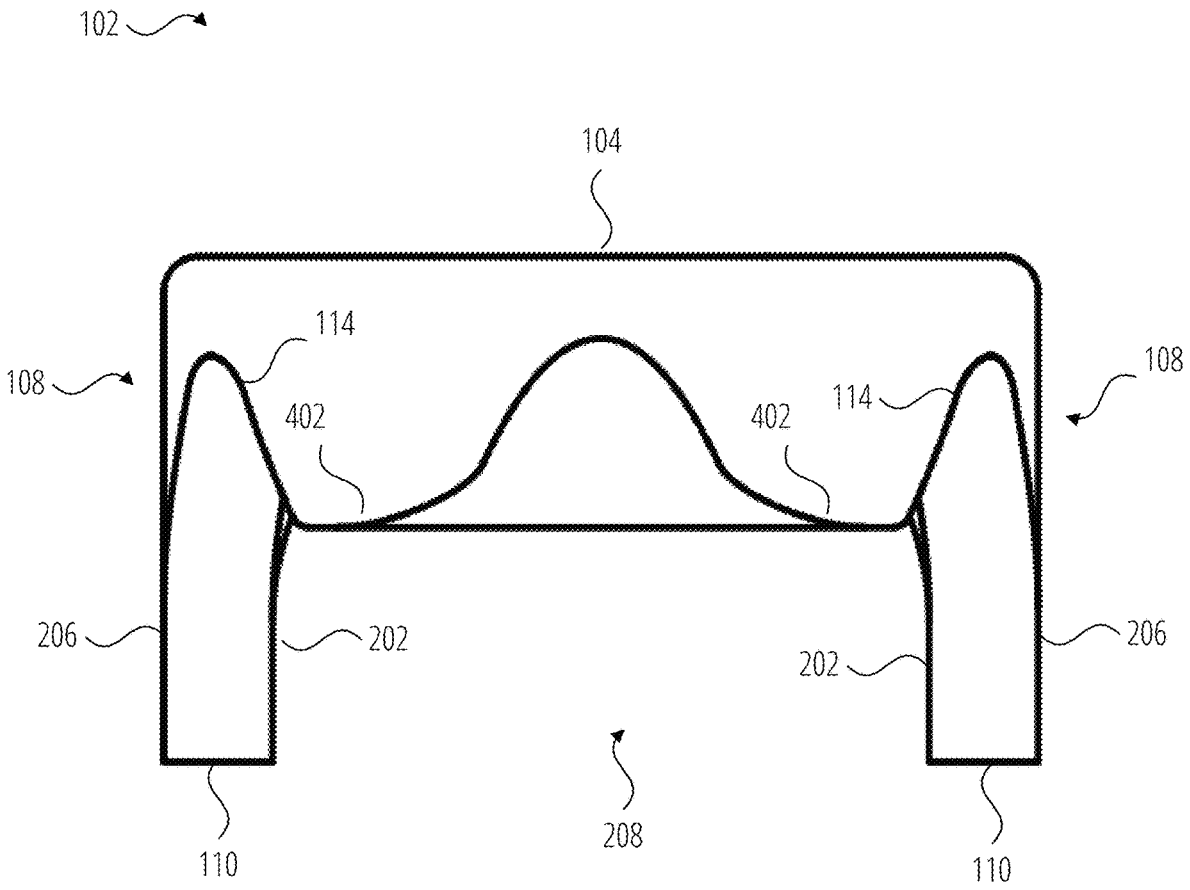
FIG. 6 illustrates an end view of the subject matter in accordance with an additional embodiment of the invention.

FIG. 6 shows an end view of the foot baseplate 102 in accordance with an additional embodiment of the invention.

The upper surface 104 can be seen to be attached to the contoured sides 108 at approximately right angles to the flat upper surface 104. The contoured sides 108 having an inner side 202 and an outer side 206. In the embodiment of the invention illustrated in FIG. 2, lower surface 204 of the foot baseplate 102 and the inner sides 202 of the contoured sides 108 form an inner space 208. The floor contact surface 110 of the foot baseplate 102 can be seen to be positioned at the lower edges of the contoured sides 108.

In the embodiment illustrated herein, the contoured sides 108 and the stop 402 and the notch 114 form a unitary structure.

Figure 7:
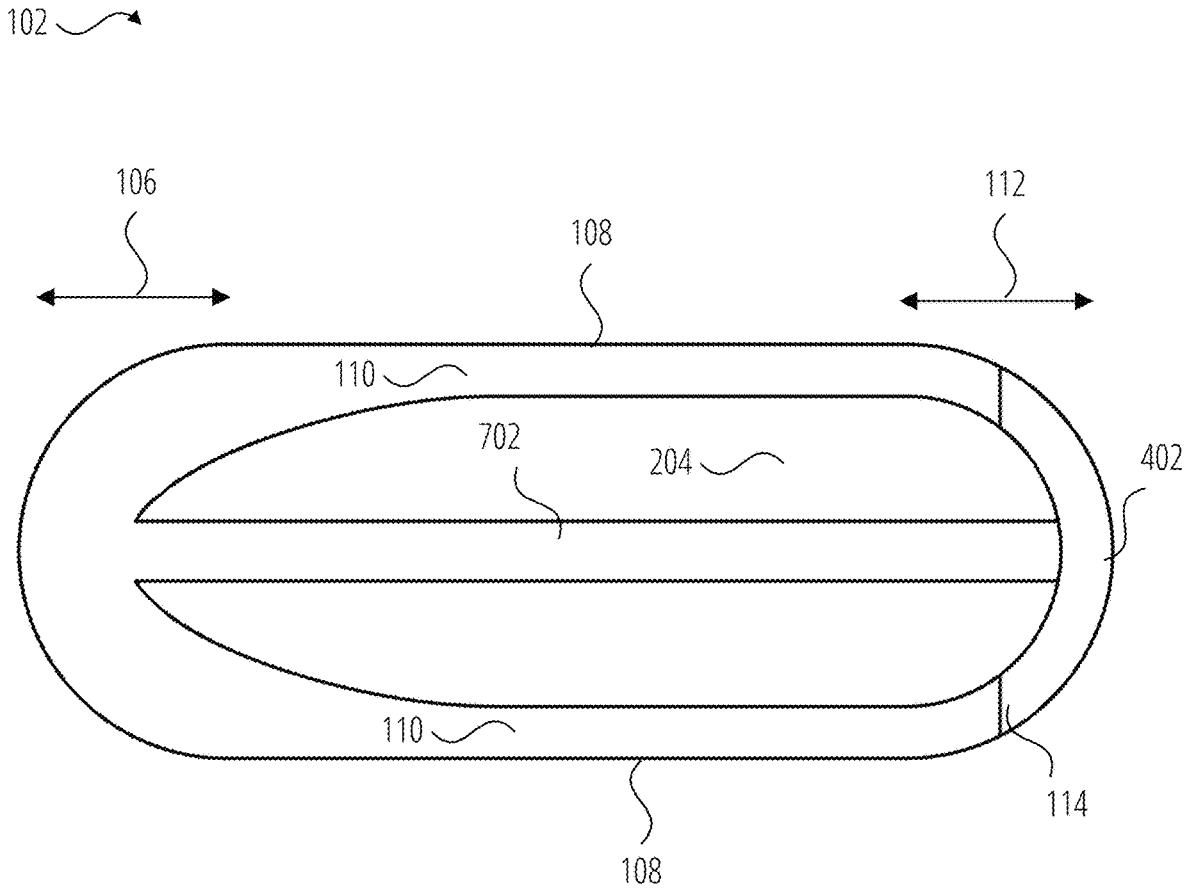
FIG. 7 illustrates an underside view of the subject matter in accordance with an additional embodiment of the invention.

FIG. 7 shows a top view of the foot baseplate 102 in accordance with an additional embodiment of the invention.

In this embodiment of the invention, the both the heel region 106 and the toe region 112 of the foot baseplate 102. The notch 114 can be seen formed in the unitary comprising the contoured sides 108 and the stop 402 of the foot baseplate 102.

Figure 8:
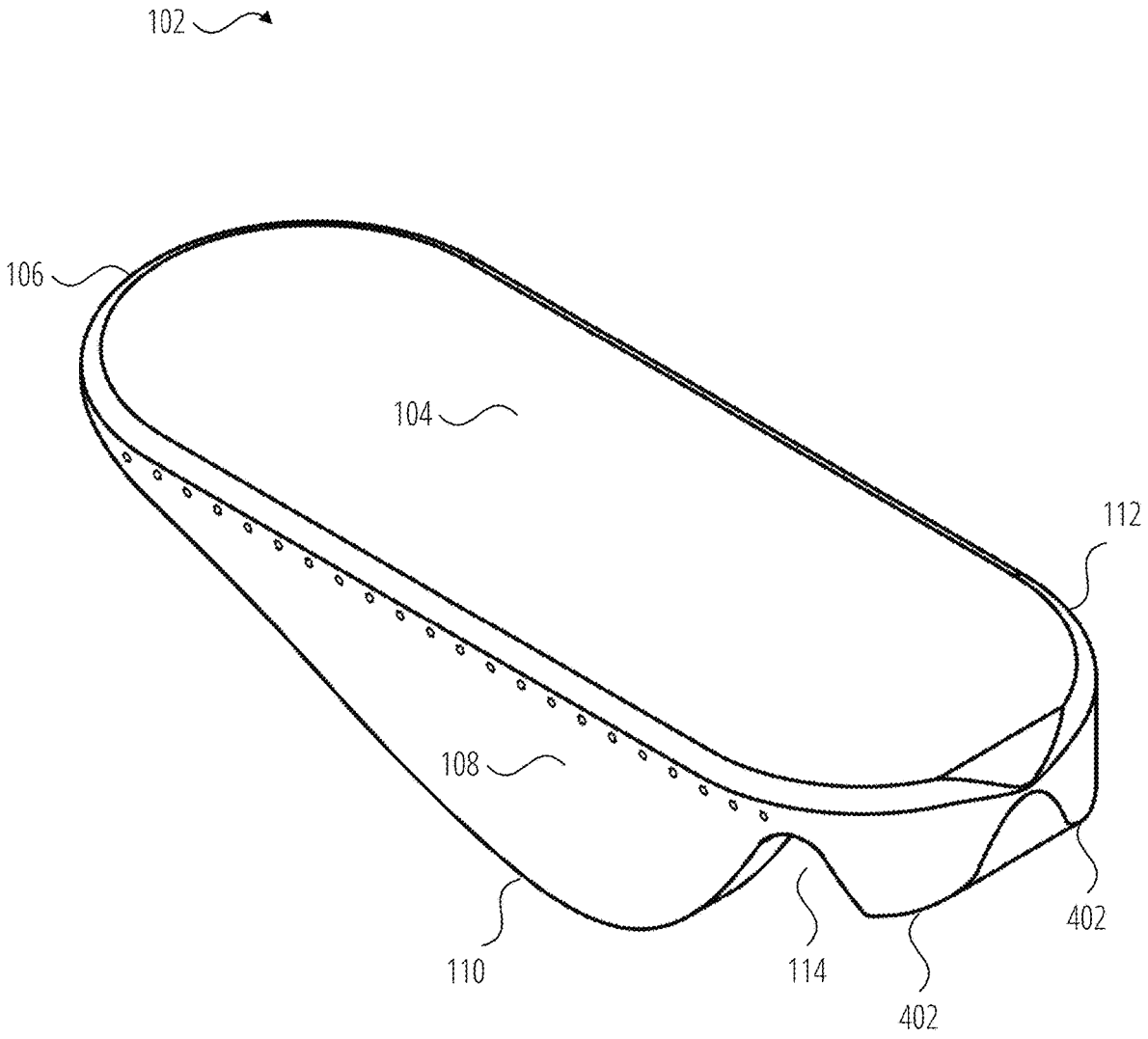
FIG. 8 illustrates a perspective view of the subject matter in accordance with an additional embodiment of the invention.

FIG. 8 shows a perspective view of the foot baseplate 102 in accordance with an additional embodiment of the invention.

The shape of the foot baseplate 102 resembles that illustrated in FIG. 7 in that it has a curved heel region 106 and a curved toe region 112. The contoured sides 108 are continuous with the stop 402 have a notch 114, as illustrated in FIG. 5. The notch 114 is formed between the floor contact surface 110 and a stop 402.

Figure 9:
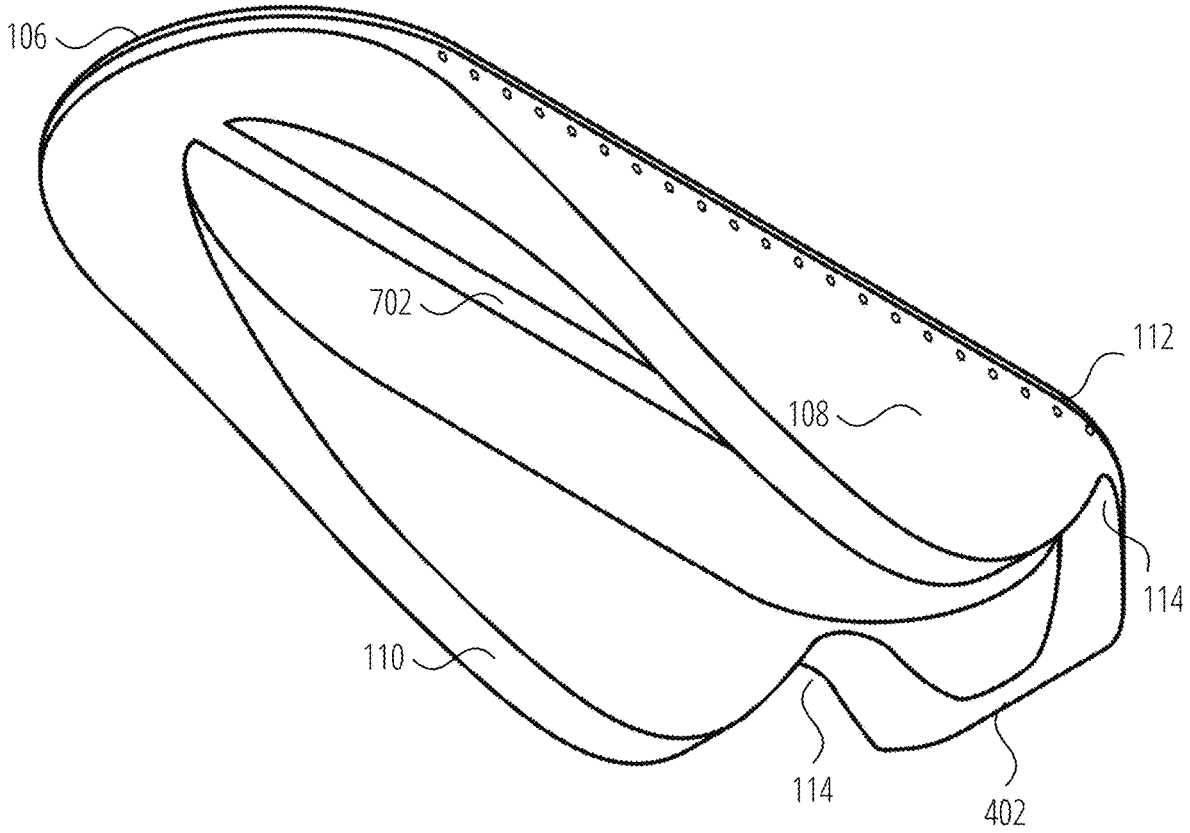
FIG. 9 illustrates a perspective view of the subject matter in accordance with an additional embodiment of the invention.

FIG. 9 shows a perspective view of the foot baseplate 102 in accordance with an additional embodiment on the invention.

The shape of the foot baseplate 102 resembles that illustrated in FIG. 7 in that it has a curved heel region 106 and a curved toe region 112. The contoured sides 108 are continuous with the stop 402 have a notch 114, as illustrated in FIG. 5. The notch 114 is formed between the floor contact surface 110 and a stop 402. The central supporting member 702 can be seen running the length of the foot baseplate 102 on the lower surface 204.

Figure 10:
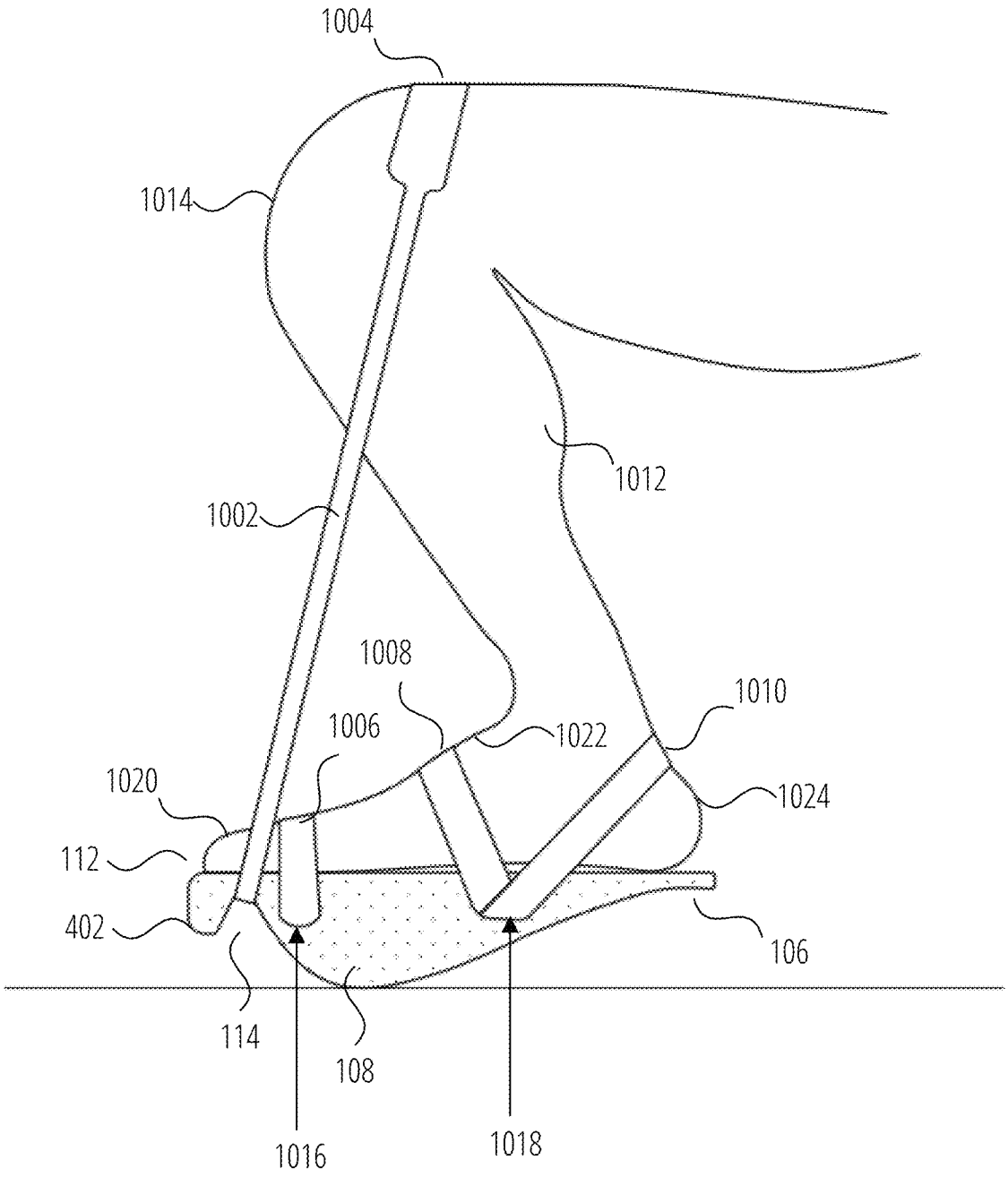
FIG. 10 illustrates a side view of the subject matter in use in accordance with one embodiment of the invention.

FIG. 10 shows a perspective view of the foot baseplate 102 in use in accordance with one embodiment.

The foot baseplate 102 can be seen to comprise a contoured side 108, a heel region 106, a toe region 112, notch 114 and stop 402.

In addition, FIG. 10 illustrates that the device may comprise several straps designed and positioned to secure the foot of the user to the foot baseplate 102. In the embodiment shown, a toe strap 1006 can be seen securing the toe 1020 of the user to the foot baseplate 102. An arch strap 1008 can be seen securing the arch 1022 of the user to the foot baseplate 102. A heel strap 1010 can be seen securing the heel 1024 of the user to the foot baseplate 102.

In this embodiment, the toe strap 1006, is connected to the contoured side 108 at a toe strap attachment point 1016. The arch strap 1008 and the heel strap 1010 are connected to the contoured side 108 at a common arch strap and heel strap attachment point 1018 in this illustrated embodiment. In other embodiments (not shown) individual attachment points are utilized to attach each strap.

The toe strap 1006, arch strap 1008 and heel strap 1010 may be attached to the foot baseplate 102 by fastening mechanisms known to those of skill in the field. Snaps or poppers may be employed, and the straps may be continuous or they may be adjustable, for example by way of poppers or hook and loop fasteners including but not limited to Velcro™. The contoured sides 108 may be fabricated to have holes or slits (not shown) extending from the contoured sides 108 to the inner sides 202. In this embodiment, the toe strap 1006, arch strap 1008 and heel strap 1010 can be slotted through the hole or slit and secured on the inner side 202.

A resistance band 1002 can also be seen fitted into the notch 114 on the foot baseplate 102. The resistance band 1002 extends from the notch 114 to the user's knee 1014 in this embodiment. In some embodiments of the invention, the resistance band 1002 has a widened section 1004 that corresponds to the region of the contact point with the knee 1014. The widened section 1004 creates a more secure friction fit and reduces pressure from the resistance band 1002 on the surrounding tissue.

In use, the user secures the foot baseplate 102 onto their foot using a series of straps. In the embodiment as shown, this includes a toe strap 1006, and arch strap 1008 and a heel strap 1010. A resistance band 1002 is selected of an appropriate length to comfortably extend around the knee of the user and around the notch 114. The user, in a seated position, rocks the foot baseplate 102 in a motion guided by the shape of the contoured sides 106. At one extreme, the toe 1020 is in an elevated position and the heel 1024 in a depressed position. In the opposite extreme, the toe 1020 is in a depressed position and the heel 1024 in an elevated position. The up and down motion of the toe 1020 and heel 1024 cause the calf muscles 1012 to sequentially contract and relax.

Figure 11:
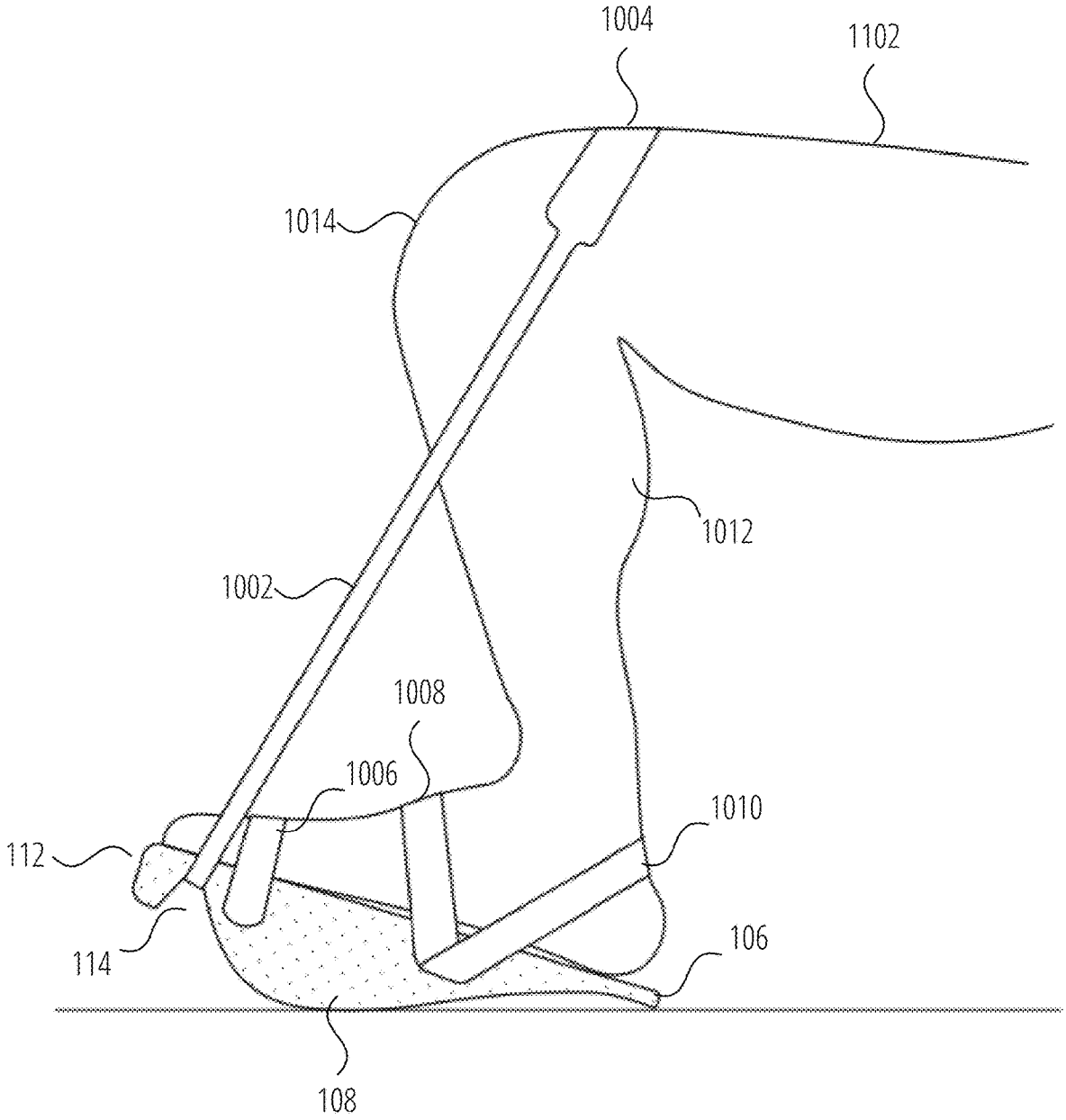
FIG. 11 illustrates another side view of the subject matter in use in accordance with one embodiment of the invention.

FIG. 11 shows a perspective view of the foot baseplate 102 in use in accordance with one embodiment.

The foot baseplate 102 can again be seen to comprise a contoured side 108, a heel region 106, a toe region 112, notch 114 and stop 402. In some embodiments of the invention, the contoured side 108, stop 402 and notch are of a unitary construction.

In this illustration, the resistance band 1002 is pulling the toe region 112 of the foot baseplate 102 in an upward direction. This motion causes the user's toes to be elevated the heel to become depressed, leading to an extension of the user's calf muscles 1012.

Figure 12:
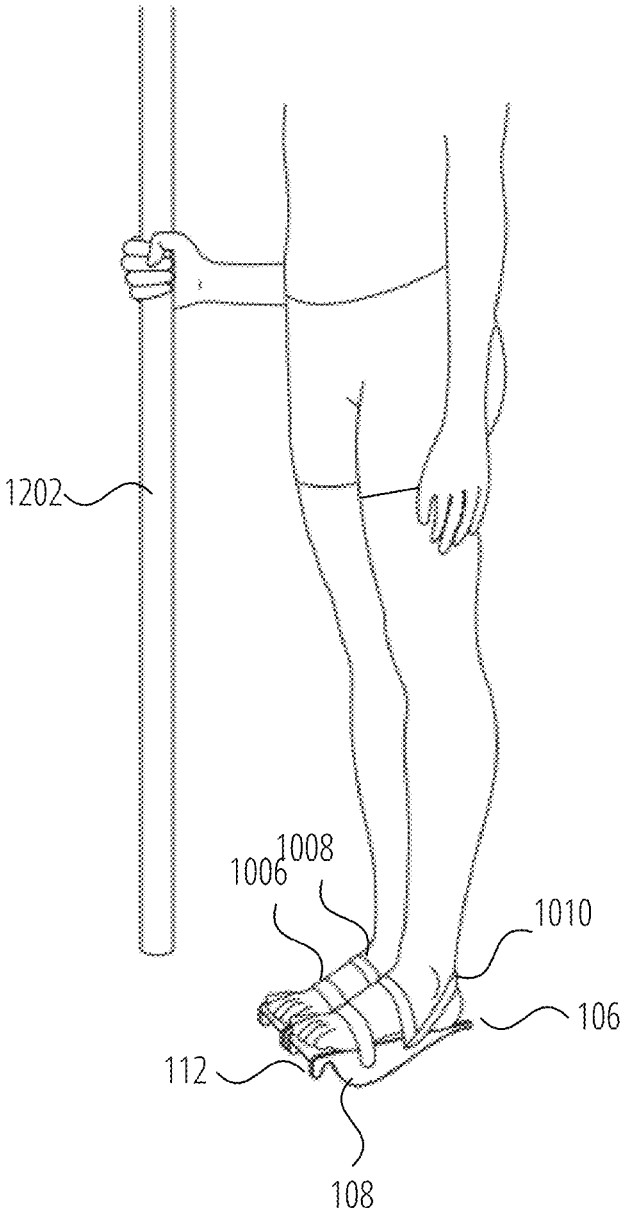
FIG. 12 illustrates a perspective view of the subject matter in an alternative use in accordance with one embodiment of the invention.

FIG. 12 shows a perspective view of the foot baseplate 102 in use in accordance with one embodiment.

The foot baseplate 102 can be seen to comprise a contoured side 108, a heel region 106, a toe region 112, notch 114 and stop 402.

In this particular embodiment, however, the user is exercising their calf muscles 1012 in the standing position. The foot baseplates 102 have been affixed to both feet as previously described using toe straps 1006, arch straps 1008 and heel straps 1010. The resistance band 1002 is not attached in this particular embodiment.

In use, the user may hold onto a support 1202, including but not limited to a pole, chair back, table or counter top, if necessary. The user then rocks back and forward, in a motion guided by the contoured sides 108, the stops 402 preventing the user from over rotating in the forward direction.

Figure 13:
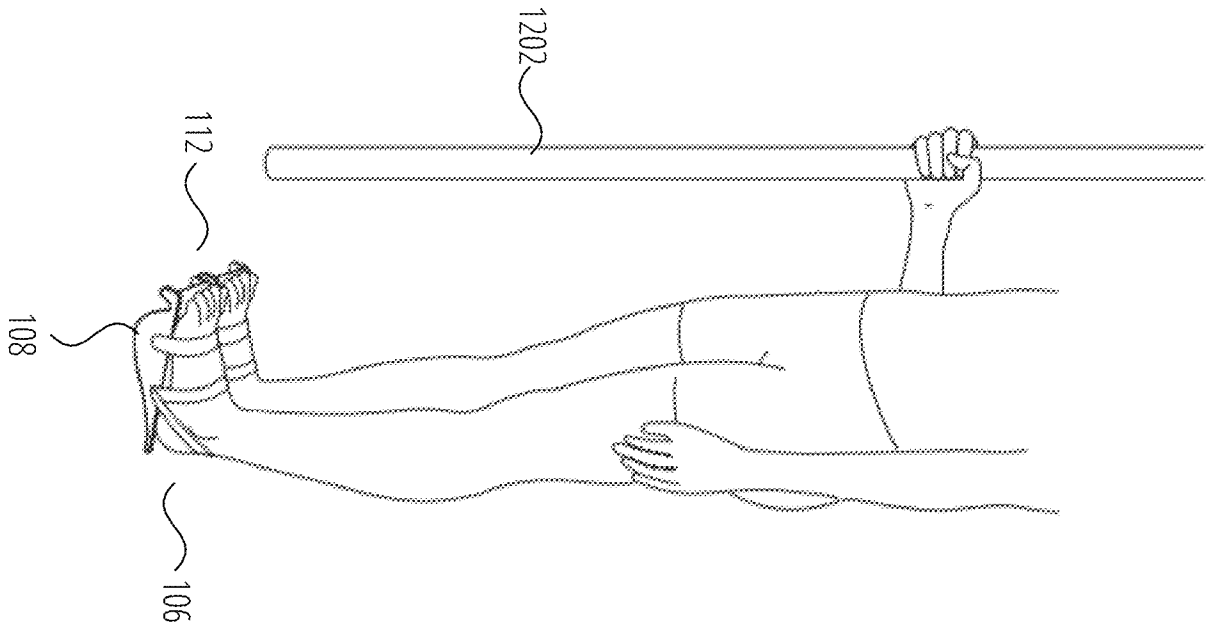
FIG. 13 illustrates a perspective view of the subject matter in yet an alternative use in accordance with one embodiment of the invention.

FIG. 13 shows a perspective view of the foot baseplate 102 in use in accordance with one embodiment.

The elements shown are as described in previous figures.

In this illustration, the user has rocked backwards pushing the heel region 106 of the foot baseplate 102 in a downward direction. This motion causes the user's toes to be elevated and the heel to become depressed, leading to an extension of the user's calf muscles 1012.

Figure 14:
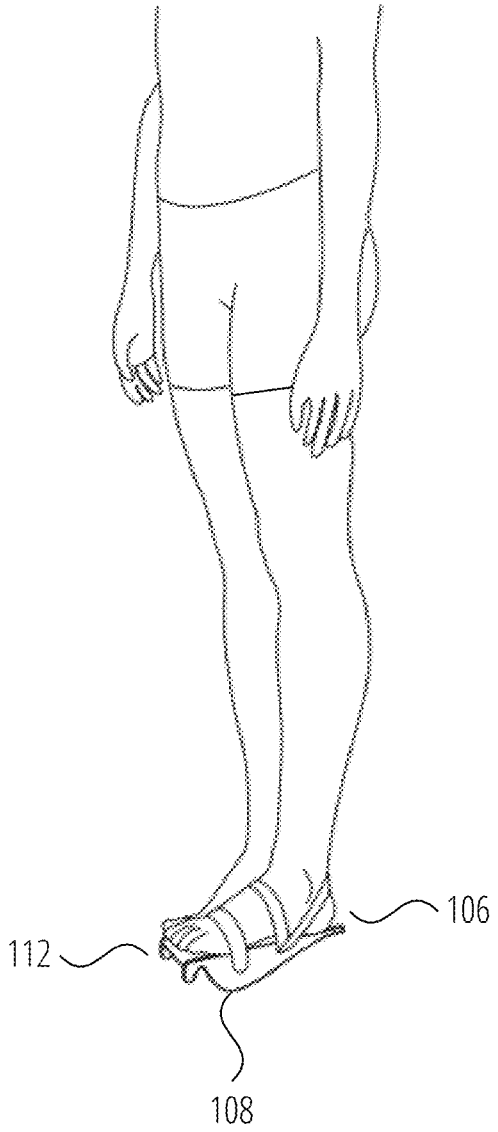
FIG. 14 illustrates a perspective view of the subject matter in an alternative use in accordance with one embodiment of the invention.

FIG. 14 shows a perspective view of the foot baseplate 102 in use in accordance with one embodiment.

The illustration resembles the use described in FIG. 12, except that the device has only been applied to one of the user's feet. The device is being used in a freestanding orientation, without support 1202.

Figure 15:
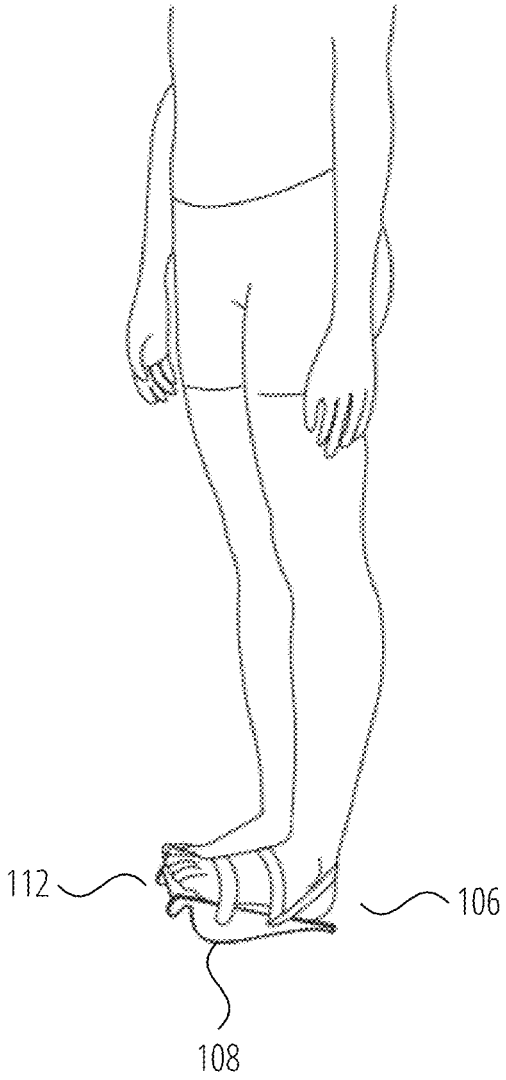
FIG. 15 illustrates a perspective view of the subject matter in yet an alternative use in accordance with one embodiment of the invention.

FIG. 15 shows a perspective view of the foot baseplate 102 in use in accordance with one embodiment.

The illustration resembles the use described in FIG. 13, except that the device has only been applied to one of the user's feet. The device is being used in a freestanding orientation, without support 1202.

In this illustration, the user has rocked backwards pushing the heel region 106 of the foot baseplate 102 in a downward direction. This motion causes the user's toes to be elevated and the heel to become depressed, leading to an extension of the user's calf muscles 1012.

Figure 16:
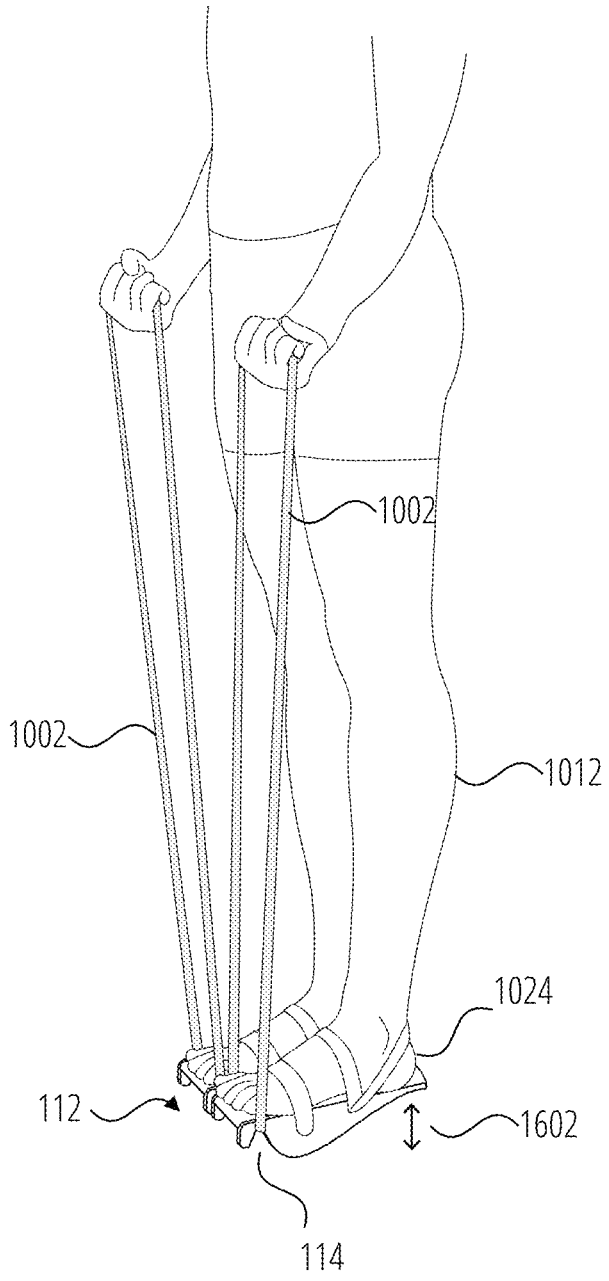
FIG. 16 illustrates a perspective view of the subject matter in an alternative use in accordance with one embodiment of the invention.
Figure 17:
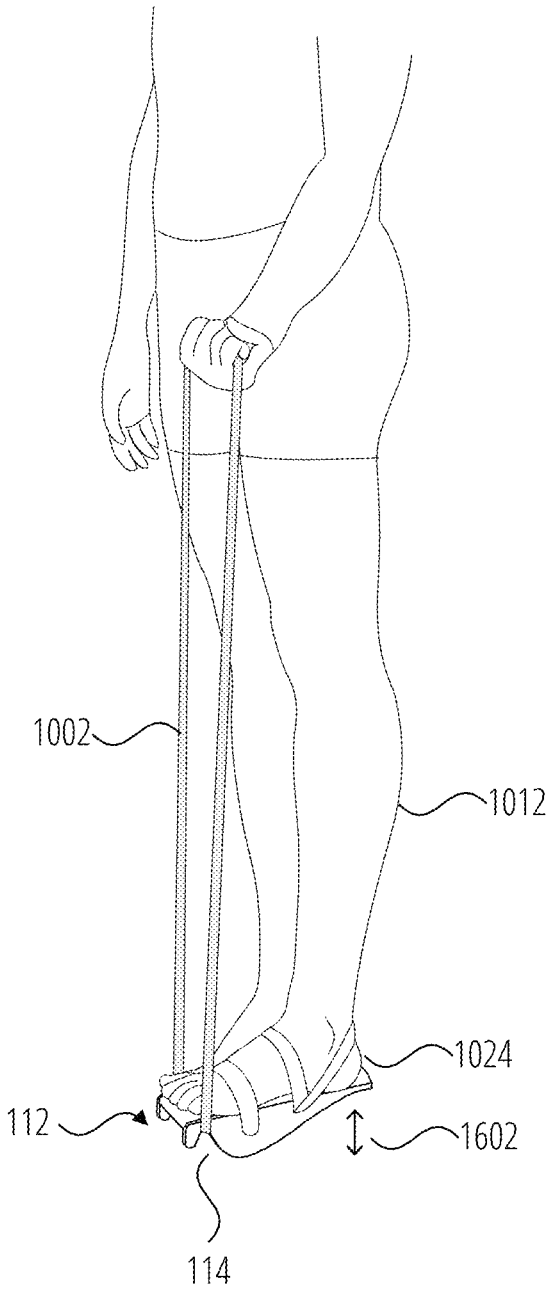
FIG. 17 illustrates a perspective view of the subject matter in an alternative use in accordance with one embodiment of the invention.

FIG. 16 shows a perspective view of the foot baseplate 102 in use in accordance with one embodiment.

The illustration resembles the use described in FIG. 12 except that the user is not steadying themselves using a support 1202. The device is being used in a freestanding orientation and a resistance band 1002 is operatively associated with the notch 114. This use of the resistance band 1002 can also function to steady the user.

The user rocks backwards and forwards, alternatively pulling the toe region 112 of the foot baseplate 102 in an upward direction with the resistance bands 1002 and then and pushing the toe region 112 in a downward direction. This motion causes the heels 1024 to be alternatively depressed and then elevated in a flexing motion 1602 indicated by the arrow, thereby leading to an extension and relaxation of the user's calf muscles 1012.

FIG. 16 shows a perspective view of the foot baseplate 102 in use in accordance with one embodiment.

The illustration resembles the use described in FIG. 16 except that the user is only using the device on one leg/foot. The device is being used in a freestanding orientation and a resistance band 1002 is operatively associated with the notch 114. This use of the resistance band 1002 can also function to steady the user. In an alternative embodiment of the invention, the resistance band is a strap having two ends with rings, sized and proportioned to engage with said hook attached to either end.

The user similarly rocks backwards and forwards, alternatively pulling the toe region 112 of the foot baseplate 102 in an upward direction with the resistance bands 1002 and then and pushing the toe region 112 in a downward direction. This motion causes the heels 1024 to be alternatively depressed and then elevated in a flexing motion 1602 indicated by the arrow, thereby leading to an extension and relaxation of the user's calf muscles 1012.

The various embodiment illustrated and described above lend themselves to be varied in several way, all of which result in embodiments that fall within the scope of protection being sought.

The shape of the foot baseplate 102 and the contoured sides 108 may be varied from the shapes illustrated in the figures. The foot baseplate 102 will be fabricate in various sizes to accommodate varying sized feet. The foot baseplate 102 can be made from various different materials including but not limited to wood, metal and plastic.

The foot baseplate 102 are well suited to be made from plastics. The plastics may be 3D printed, injection molded or extruded. An example of 3D printable plastics includes polylactic acid, or PLA, this material has the benefit of being biodegradable as it is manufactured using renewable raw materials such as corn starch. ABS filament another type of 3D printing thermoplastic which contains a base of elastomers based on polybutadiene, making it more flexible, and resistant to shocks. ASA is a material that has similar properties to ABS, but has a greater resistance to UV rays. Polyethylene terephthalate, or PET, is ideal for fabricating larger more rigid frames. PETG, is a glycolyzed PET polymer that combines both the simplicity of PLA 3D printing and the strength of ABS, and it is 100% recyclable. Numerous other 3D printable polymers, hybrids and composites are known and considered to be within the scope of protection sought. Plastics that are particularly suitable for injection molding include Nylon™, acrylics, which are particularly suitable for being tinted, polycarbonate (PC), polyoxymethylene (POM), polystyrene (PS), acrylonitrile butadiene styrene (ABS), polypropylene (PP), polyethylene (PE), thermoplastic polyurethane (TPU), and thermoplastic rubber (TPR). Plastics that are particularly suitable for extrusion include polyethylene (PE), polypropylene, acetal, acrylic, nylon (polyamides), polystyrene, polyvinyl chloride (PVC), acrylonitrile butadiene styrene (ABS) and polycarbonate.

The straps that hold the foot baseplate 102 onto the user's foot may comprise one or more of the toe strap 1006, arch strap 1008 and heel strap 1010. They may be attached to the surface of the foot baseplate 102, or to the contoured sides 108 of the device. They may be attached individually or in combinations as illustrated in FIGS. 10 to 10. The straps may be attached to the foot baseplate 102 or contoured sides 108 through holes or slits, the straps being threaded through the holes or slits and fastened to the inner side 202 or floor contact surface 110 by conventional fasteners. The straps may be continuous or they may be in two separate pieces that can be joined by poppers, snaps or hook and loop fasteners to accommodate different diameters of feet. In the alternative, the straps may be made from elastic, expanding to accommodate different sizes and shapes of foot.

The resistance bands 1002 can be supplied in various resistance levels. They may be continuous loops that cooperate with the notch 114 on the foot baseplate 102 or they can be strips having a hook or loop at either end that attached to a cooperating hook or loop on either side of the toe region 112 of the foot baseplate 102. The resistance bands 1002 are typically made from a polymeric or rubber material. The resistance bands 1002. May have widened sections 1004 or pads located in the region of the user's knee 1014 to render the device more comfortable to use. When the resistance bands are used in the standing position, it is typical that they are longer than the ones used in the sitting position.

The foregoing descriptions of specific embodiments of the present invention have been presented for purposes of illustration and description. They are not intended to be exhaustive or to limit the invention and method of use to the precise forms disclosed. Many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A calf exercise device, comprising:

a planar baseplate having an approximate size and shape of a user's foot, said baseplate having a toe region and a heel region and two essentially parallel side edges extending therebetween;

a pair of similarly sized and shaped contoured side pieces, each of said contoured side pieces having an upper edge and a lower edge, each of said upper edges attached to one of said parallel side edges, and each of said lower edges having a convex shaped floor contact surface, said convex shaped floor contact surface having an asymmetric shape gradually increasing from the toe region to a peak at a position approximating a position of the ball of said user's foot when said user's foot is positioned on said planar baseplate, and then gradually decreasing from said peak to said heel region, with a rate of said gradual increase being greater than a rate of said gradual decrease;

one or more straps affixed to either said parallel side edges of said baseplate or said upper edges of said pair of contoured side pieces, one or more of said one or more straps positioned to extend over one or more of toes, arch or heel of said user's foot; and a notch formed in said pair of contoured side pieces, said notch sized and configured to cooperate with a resistance band, wherein said notch is positioned in said region of said user's toes and said convex shaped floor contact surface is positioned in a region of said user's arch when said user's foot is positioned on said planar baseplate.

2. The calf exercise device of claim 1, wherein said baseplate, said pair of contoured side pieces, and said notch, are a unitary structure.

3. The calf exercise device of claim 2, wherein said unitary structure is fabricated from plastic.

4. The calf exercise device of claim 2, wherein said unitary structure is fabricated by 3D printing, injection molding or plastic extrusion.

5. The calf exercise device of claim 1, wherein said notch forms a stop at said toe region.

6. The calf exercise device of claim 5, wherein said notch and said stop are a unitary structure.

7. The calf exercise device of claim 1, wherein said resistance band is a loop.

8. The calf exercise device of claim 7, wherein said resistance band has a widened section or a pad attached to said band.

9. The calf exercise device of claim 1, wherein said resistance band is releasably attached to said notch.

10. The calf exercise device of claim 1, wherein said one or more straps are fabricated from elastic.

11. The calf exercise device of claim 1, wherein said one or more straps are each fabricated from two strips of fabric or strapping, joined by hook and loop fasteners.

12. A method of exercising a user's calf muscles, using a first calf exercise device, said first calf exercise device comprising:

a planar baseplate having an approximate size and shape of a user's foot, said baseplate having a toe region and a heel region and two essentially parallel side edges extending therebetween;

a pair of similarly sized and shaped contoured side pieces, each of said contoured side pieces having an upper edge and a lower edge, each of said upper edges attached to one of said parallel side edges, and each of said lower edges having a convex shaped floor contact surface;

one or more straps affixed to either said parallel side edges of said baseplate or said upper edges of said pair of contoured side pieces, one or more of said one or more straps positioned to extend over one or more of toes, arch or heel of said user's foot; and a notch formed in said pair of contoured side pieces, said notch sized and configured to cooperate with a resistance band, wherein said notch is positioned in said region of said user's toes, and said convex shaped floor contact surface is positioned in a region of said user's arch when said user's foot is positioned on said planar baseplate, said method comprising:

said user sitting on an object having a distance from a floor that results in said user's lower and upper leg being at an approximate right angle at said user's knee joint;

inserting one or more of said user's toes, arch and heel of one of said user's feet between said one or more straps and said baseplate, forming a resting position;

attaching said resistance band to said notch;

attaching said resistance band to a horizontal section of said user's upper leg;

said user pushing said toes down onto said baseplate, against said resistance band to a flexing position;

said user relaxing and allowing said resistance band to pull said baseplate back to said resting position; and said user repeating said pushing and relaxing to move between said flexing and relaxing positions.

13. The method of claim 12, further comprising attaching a second calf exercise device identical to the first calf exercise device to a second foot of the user, thereby enabling flexing both of said user's lower legs.

14. A method of exercising a user's calf muscles, using a first calf exercise device comprising:

a planar baseplate having an approximate size and shape of a user's foot, said baseplate having a toe region and a heel region and two essentially parallel side edges extending therebetween;

a pair of similarly sized and shaped contoured side pieces, each of said contoured side pieces having an upper edge and a lower edge, each of said upper edges attached to one of said parallel side edges, and each of said lower edges having a convex shaped floor contact surface;

one or more straps affixed to either said parallel side edges of said baseplate or said upper edges of said pair of contoured side pieces, one or more of said one or more straps positioned to extend over one or more of toes, arch or heel of said user's foot; and a notch formed in said pair of contoured side pieces, said notch sized and configured to cooperate with a first resistance band, wherein said notch is positioned in said region of said user's toes, and said convex shaped floor contact surface is positioned in a region of said user's arch when said user's foot is positioned on said planar baseplate, said method comprising:

said user standing on a flat surface;

inserting one or more of said user's arch, toes, and heel of one of said user's feet between said one or more straps and said baseplate, forming a resting position;

attaching said first resistance band to said notch;

holding said first resistance band with said user's hand;

said user pushing said toes down onto said baseplate, against said first resistance band to a flexing position;

said user relaxing and allowing said first resistance band to pull said baseplate back to said resting position; and said user repeating said pushing and relaxing to move between said flexing and relaxing positions.

15. The method of claim 14, further comprising attaching a second calf exercise device identical to the first calf exercise device to a second foot of the user, attaching a second resistance band to the notch of the second calf exercise device, and respectively holding the first and second resistance bands in each of said user's hands, thereby flexing both of said user's lower legs.

* * * * *